US009193154B2

(12) United States Patent
Toda et al.

(10) Patent No.: US 9,193,154 B2
(45) Date of Patent: Nov. 24, 2015

(54) LIQUID EJECTION HEAD AND LIQUID EJECTION APPARATUS

(71) Applicant: CANON KABUSHIKI KAISHA, Tokyo (JP)

(72) Inventors: Kyosuke Toda, Kawasaki (JP); Hirotaka Miyazaki, Yokohama (JP); Hiromasa Amma, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/228,591

(22) Filed: Mar. 28, 2014

(65) Prior Publication Data

US 2014/0307027 A1 Oct. 16, 2014

(30) Foreign Application Priority Data

Apr. 12, 2013 (JP) ..... 2013-083710

(51) Int. Cl.

| | |
|---|---|
| ***B41J 2/015*** | (2006.01) |
| ***B41J 2/165*** | (2006.01) |
| ***B41J 2/14*** | (2006.01) |
| ***B41J 2/045*** | (2006.01) |

(52) U.S. Cl.

CPC .. *B41J 2/045* (2013.01); *B41J 2/14* (2013.01); *B41J 2/16544* (2013.01); *B41J 2002/14362* (2013.01); *B41J 2002/14491* (2013.01)

(58) Field of Classification Search

CPC .. B41J 2/1623; B41J 2/14024; B41J 2/14072; B41J 2/14; B41J 2002/14362; B41J 2002/14491; B41J 2/045; B41J 2/16544

USPC ..... 347/33, 50, 20

See application file for complete search history.

(56) References Cited

U.S. PATENT DOCUMENTS

| | | | | |
|---|---|---|---|---|
| 5,751,324 | A | 5/1998 | Brandon et al. | |
| 8,079,674 | B2 | 12/2011 | Kurihara et al. | |
| 8,191,988 | B2 | 6/2012 | Matsui et al. | |
| 8,246,146 | B2 | 8/2012 | Toda et al. | |
| 8,272,130 | B2 | 9/2012 | Miyazaki | |
| 8,550,599 | B2 | 10/2013 | Miyazaki et al. | |
| 8,562,109 | B2 | 10/2013 | Miyazaki et al. | |
| 2009/0267994 | A1 * | 10/2009 | Suganuma et al. | 347/59 |

(Continued)

FOREIGN PATENT DOCUMENTS

| | | |
|---|---|---|
| CN | 101607477 A | 12/2009 |
| CN | 102673155 A | 9/2012 |

(Continued)

OTHER PUBLICATIONS

Office Action in Chinese Patent Application No. 201410144061.5, dated Jun. 30, 2015.

*Primary Examiner* — Jannelle M Lebron

(74) *Attorney, Agent, or Firm* — Fitzpatrick, Cella, Harper & Scinto

(57) ABSTRACT

A liquid ejection head includes a recording element substrate having an ejection port, a support member having a recessed portion and supporting the recording element substrate by a bottom portion of the recessed portion, wiring electrically connected to the recording element substrate and extending between the recording element substrate and a side surface of the recessed portion, a sealant with which the wiring is covered, and a passage formed in the support member and allowing a first region where the sealant is placed and a second region different from the sealed region to communicate with each other.

7 Claims, 6 Drawing Sheets

(56) References Cited

U.S. PATENT DOCUMENTS

| | | | |
|---|---|---|---|
| 2010/0097427 | A1 | 4/2010 | Owaki |
| 2010/0097428 | A1 | 4/2010 | Owaki |
| 2012/0287205 | A1 | 11/2012 | Miyazaki |

FOREIGN PATENT DOCUMENTS

| | | | |
|---|---|---|---|
| JP | 10-006522 | A | 1/1998 |
| JP | 4428731 | B2 | 3/2010 |
| JP | 2010-137554 | A | 6/2010 |

* cited by examiner

LIQUID EJECTION HEAD AND LIQUID EJECTION APPARATUS

BACKGROUND OF THE INVENTION

1. Field of the Invention

The present invention relates to a liquid ejection head that ejects a liquid, and a liquid ejection apparatus that has the liquid ejection head mounted thereon and performs recording onto a recording medium.

2. Description of the Related Art

A liquid ejection apparatus typified by an inkjet type liquid ejection apparatus has become widespread, because running cost at the time of recording is relatively inexpensive, and the operation sound is relatively quiet. One example of the liquid ejection head (hereinafter, also called a "recording head") that is mounted on a liquid ejection apparatus is disclosed in Japanese Patent Application Laid-Open No. H10-6522.

The recording head disclosed in Japanese Patent Application Laid-Open No. H10-6522 includes a print head assembly having a nozzle, an electric wiring board such as an electric circuit, and a cartridge body. Note that the nozzle, the print head assembly and the cartridge body are also respectively called an ejection port, a recording element substrate and a support member.

The recording element substrate and the electric wiring board are electrically connected via a plurality of lead terminals. The support member has a recessed portion as a die cavity, and supports the recording element substrate by a bottom portion of the recessed portion. The lead terminal extends between the recording element substrate and a side surface of the recessed portion.

Further, the recording head includes a sealant formed from a thermosetting adhesive. The lead terminals are covered with the sealant, and the electrically connected portions between the lead terminals and the recording element substrate, and the electrically connected portions between the lead terminals and the electric wiring board are protected with use of the sealant.

As the manufacturing method of the recording head disclosed in Japanese Patent Application Laid-Open No. H10-6522, the following two methods are cited.

The first method is a method that fixes the recording element substrate and the electric wiring board to the support member, after connecting the recording element substrate and the electric wiring board via the lead terminals, and covering the lead terminals with the sealant. The second method is a method that covers the lead terminals with the sealant, after connecting the recording element substrate and the electric wiring board via the lead terminals and fixing the recording element substrate and the electric wiring board to the support member. The second method has the advantage that at the time of manufacturing the recording head, foreign matters hardly enter the nozzle plate in which the ejection port is formed.

The second method will be described in more detail. The sealant is applied onto the lead terminals after the recording element substrate and the electric wiring board are fixed to the support member, and the sealant flows into the gap between the recording element substrate and the side surface of the recessed portion from between the adjacent lead terminals. The gap is filled with the sealant, whereby the lead terminals are buried in the sealant. As a result, the lead terminals are covered with use of the sealant.

In the second method, in the case of the sealant being caused to flow into the aforementioned gap by one coating operation, the sealant traps air in the gap, and bubbles are sometimes formed in the gap. The bubbles rapidly expand at the time of curing by heating. By rapid expansion of bubbles, the sealant is scattered, and the lead terminals are not sealed by the sealant. As a result, imperfect sealing is likely to occur.

In the recording head disclosed in Japanese Patent Application Laid-Open No. H10-6522, an atmosphere communication passage that discharges gas is formed in the support member in order to restrain formation of bubbles and rapid expansion of the bubbles as above. One opening of the atmosphere communication passage is located in a side surface of the recessed portion, and the other opening of the atmosphere communication passage is located in an outer peripheral surface of the support member.

When the sealant is injected into the gap, the gas in the gap between the recording element substrate and the side surface of the recessed portion is discharged to the outside of the recording head through the atmosphere communication passage. Accordingly, the gas in the gap becomes difficult to trap by the sealant, and bubbles become difficult to form. Further, even if bubbles are formed, the gas in the bubbles is discharged to the outside through the atmosphere communication passage when the sealant is cured by heating. Therefore, the sealant is difficult to scatter, and imperfect sealing hardly occurs.

Incidentally, in a liquid ejection apparatus, a liquid (an ink) sometimes adheres to the ejection port by drying, and the recording head is brought into a state incapable of ejection. Therefore, a liquid ejection apparatus is proposed, which includes a cap and a suction pump for restraining adhesion of the ink in the ejection port, and returning the recording head that is in a state incapable of ejection into a state capable of ejection.

With the cap, at least the recording element substrate and the opening of the recessed portion are covered, and the recessed portion is hermetically sealed, when the recording head does not eject an ink. The recessed portion is hermetically sealed with use of the cap, whereby the ink hardly dries, and the ink hardly adheres to the ejection port.

The suction pump is connected to the cap. The suction pump operates and sucks the ink, in the state in which the opening of the recessed portion of the support member is covered with the cap. The ink is sucked to a cap side, whereby the ink adhering to the ejection port is removed, and the recording head returns to the state capable of ejection.

However, in the recording head disclosed in Japanese Patent Application Laid-Open No. H10-6522, adhesion of the ink cannot be sufficiently restrained, and the adhering ink cannot be sometimes removed with use of the suction pump, even if the opening of the recessed portion of the support member is covered with use of the cap. Hereinafter, the reason will be described specifically.

The coating amount of the sealant at the time of manufacturing the recording head sometimes varies, and when the coating amount of the sealant is not sufficient, one opening of the atmosphere communication passage is not covered with the sealant. Accordingly, even after the sealant is cured, the recessed portion still remains in communication with the outside of the recording head through the atmosphere communication passage. In the recording head disclosed in Japanese Patent Application Laid-Open No. H10-6522, the other opening of the atmosphere communication passage is located in the outer peripheral surface of the support member, and is not covered with the cap of the liquid ejection apparatus.

Since the other opening of the atmosphere communication passage is not closed, the recessed portion is not hermetically sealed even when the opening of the recessed portion is covered with the cap. As a result, the ink easily dries, and adherence of the ink cannot be sufficiently restrained. Further, even when the suction pump is operated, the gas outside the recording head is sucked through the atmosphere communication passage, and the adhering ink cannot be removed.

SUMMARY OF THE INVENTION

In order to attain the above described object, a liquid ejection head includes a recording element substrate having an ejection port, a support member having a recessed portion, and supporting the recording element substrate by a bottom portion of the recessed portion, wiring electrically connected to the recording element substrate, and extending between the recording element substrate and a side surface of the recessed portion, a sealant with which the wiring is covered, and a passage formed in the support member, and allowing a first region where the sealant is placed, and a second region different from the sealed region to communicate with each other.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

While embodiments of the present invention are described with use of a liquid ejection cartridge in which a liquid ejection head typified by an inkjet recording head that ejects a liquid such as an ink and a liquid vessel are integrated here, the present invention can be also applied to a form in which a liquid vessel is attachable to and detachable from a liquid ejection head.

Figure 1:
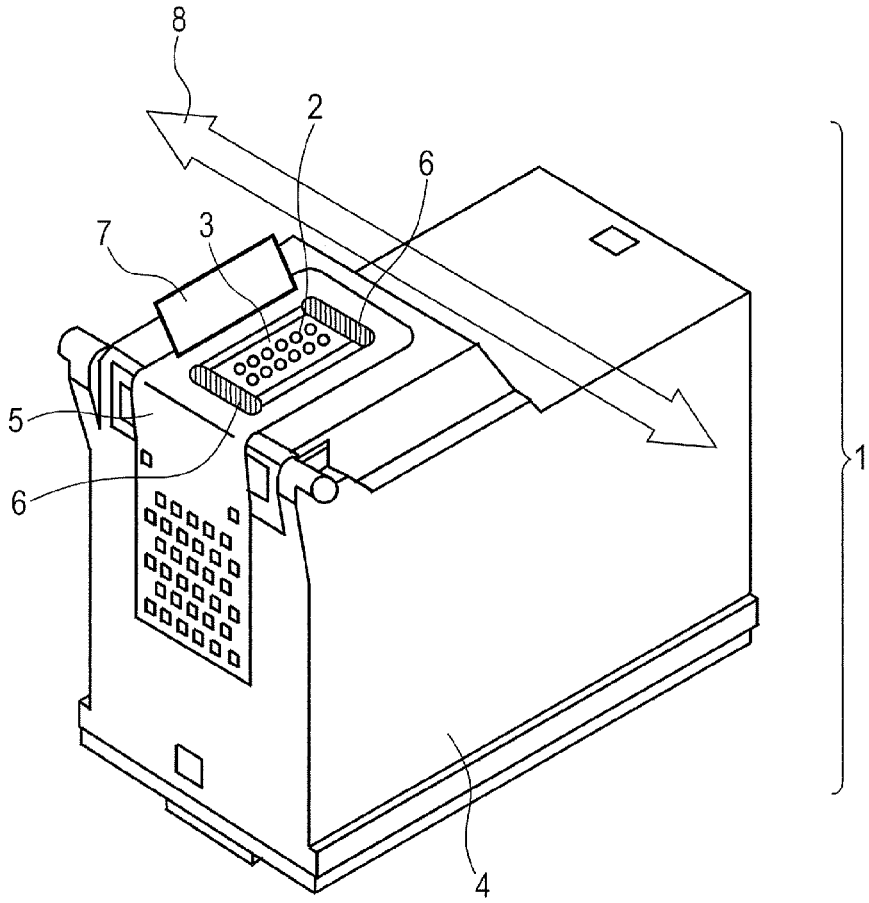
FIG. 1 is a perspective view of a liquid ejection cartridge including a recording head according to embodiments of the present invention.

FIG. 1 is a perspective view of a liquid ejection cartridge that includes a recording head according to embodiments of the present invention. The recording head of a liquid ejection cartridge 1 illustrated in FIG. 1 includes a recording element substrate 3 having an ejection port 2, and a support member 4 that supports the recording element substrate 3. The support member 4 is formed as a vessel, and a liquid such as an ink is accommodated in the support member 4.

The recording element substrate 3 is electrically connected to an electric wiring board 5 such as an electric circuit (also called "TAB"). An electrically connected portion between the recording element substrate 3 and the electric wiring board 5 is covered with use of a sealant 6.

If the ink adheres or a foreign matter sticks to a periphery of the ejection port 2, the ejection port 2 is clogged, and the ink is not ejected from the recording head normally. Therefore, it is proposed to mount a recording head on a liquid ejection apparatus that restrains clogging of the ejection port 2, and a liquid ejection apparatus including a function of eliminating clogging of the ejection port 2 and returning the recording head to a normal state.

As a method of restraining clogging of the ejection port 2, a method that covers the recording element substrate 3 with use of a cap (not illustrated) provided at the liquid ejection apparatus, and forms a hermetically sealed space is cited. By forming the hermetically sealed space, the ink hardly dries, and the ink hardly adheres to a periphery of the ejection port 2. As a result, the ejection port 2 is hardly clogged.

As a method of eliminating clogging of the ejection port 2, a method that forms a hermetically sealed space by using a cap, and decompresses the hermetically sealed space by using decompressing means that is connected to the cap to suck an ink is cited. The decompressing means is, for example, a suction pump. By sucking the ink, the ink adhering to the periphery of the ejection port 2, and the foreign matters sticking to the periphery of the ejection port 2 are removed, and clogging of the ejection port 2 is eliminated.

As another method of eliminating clogging of the ejection port 2, a method that wipes the recording element substrate 3 by moving a wiping member 7 that is provided at the liquid ejection apparatus in a predetermined direction 8 is cited. The wiping member 7 is, for example, a wiper, and the wiping member 7 wipes the recording element substrate 3, whereby the adhering ink and foreign matters are wiped away. The direction 8 in which the wiping member 7 moves (hereinafter, also called a "moving direction 8") is not limited to the example illustrated in FIG. 1, and differs in accordance with the specifications of liquid ejection apparatuses.

Hereinafter, recording heads according to first to third embodiments of the present invention will be described with use of FIGS. 2 to 11. Note that the same elements as the elements illustrated in FIG. 1 are assigned with the same reference numerals.

(First Embodiment)

First, a first embodiment according to the present invention will be described with use of FIGS. 2 to 5.

Figure 2:
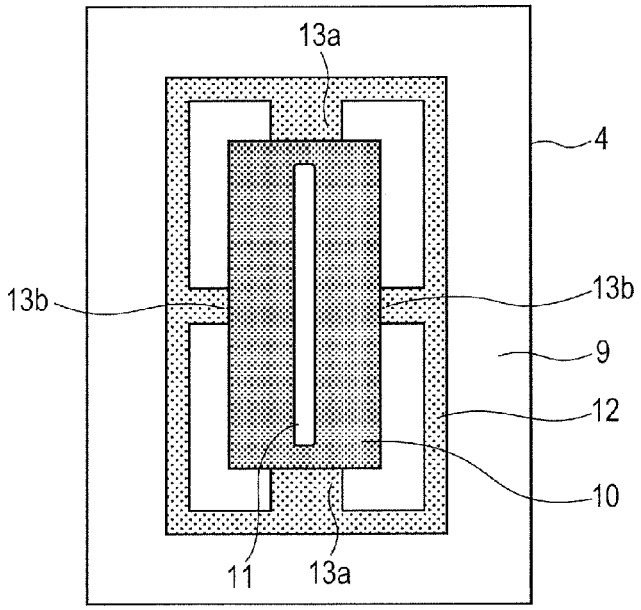
FIG. 2 is a front view of a support member of a recording head according to a first embodiment of the present invention, seen from a recording element substrate side.
Figure 3:
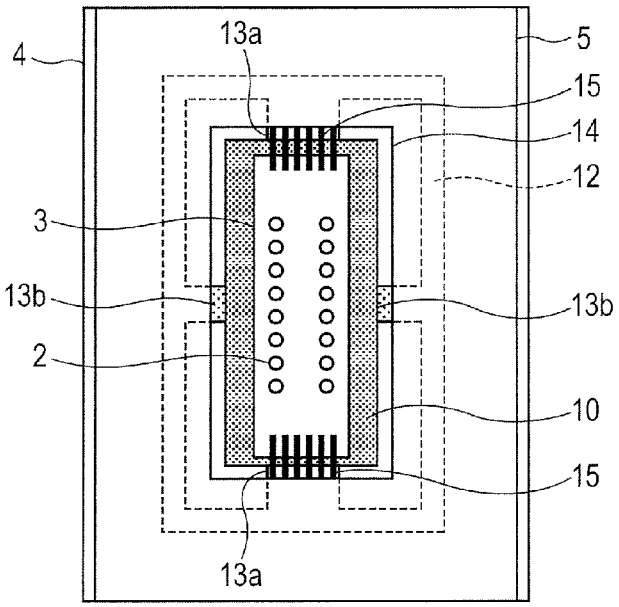
FIG. 3 is a front view of a state in which a recording element substrate and an electric wiring board are disposed at the support member illustrated in FIG. 2.
Figure 4:
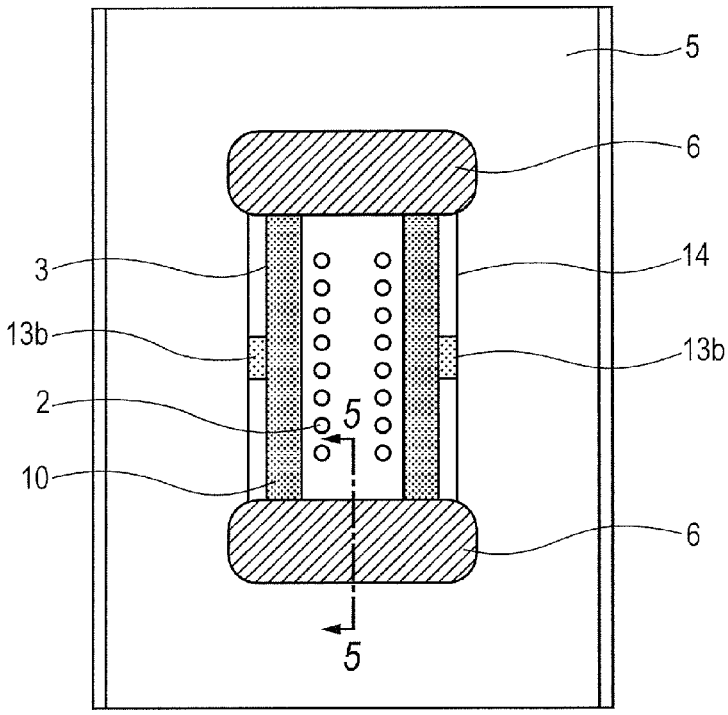
FIG. 4 is a front view of a state in which a sealant 6 is disposed at the support member illustrated in FIG. 3.
Figure 5:
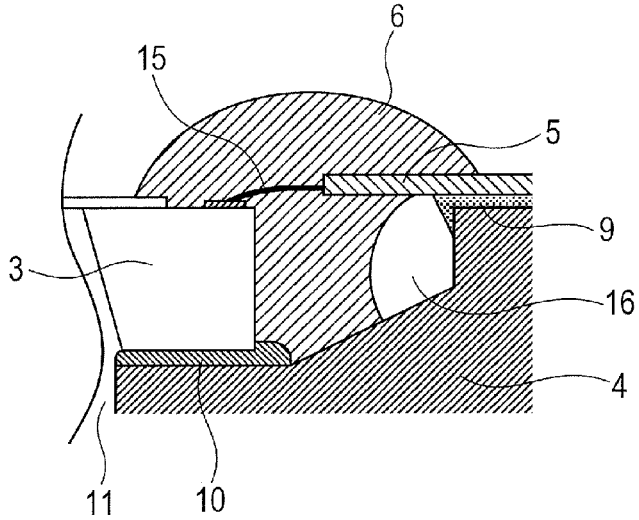
FIG. 5 is a sectional view of the recording head illustrated in FIG. 4.

FIG. 2 is a front view of the support member 4 of a recording head according to the present embodiment, seen from a recording element substrate 3 side. FIG. 3 is a front view of a state in which the recording element substrate 3 and the electric wiring board 5 are disposed at the support member 4 illustrated in FIG. 2. FIG. 4 is a front view at a time when the sealant 6 is disposed at the support member 4 illustrated in FIG. 3. FIG. 5 is a sectional view of the recording head illustrated in FIG. 4 at the time of being cut along a 5-5 plane.

As illustrated in FIG. 2, the support member 4 includes an electric wiring board support plane 9 that supports the electric wiring board 5, and a recessed portion 10 that is formed in the electric wiring board support plane 9. An ink supply port 11 that communicates with an ink accommodation space is formed in a bottom surface of the recessed portion 10.

Further, the support member 4 has a groove 12 that is formed in the electric wiring board support plane 9. The groove 12 includes a loop-shaped groove portion that is formed into a loop shape in a periphery of the recessed portion 10, and at least two linear groove portions that extend from the loop-shaped groove portion to an inside of the recessed portion. In the present embodiment, the groove 12 includes four linear groove portions.

Note that in each of FIGS. 2 to 4, a region having dots with relatively high density represents a region of the bottom portion of the recessed portion 10, and a region having dots with relatively low density represents a region of the bottom portion of the groove 12.

As illustrated in FIG. 3, the support member 4 supports the support member 4 by the bottom portion of the recessed portion 10, and supports the electric wiring board by the electric wiring board support plane 9. More specifically, the bottom portion of the recessed portion 10 and the electric wiring board support plane 9 are coated with an adhesive, and the recording element substrate 3 and the electric wiring board 5 that are electrically connected to each other are caused to adhere onto the bottom portion of the recessed portion 10 and the electric wiring board support plane 9.

In a state in which the electric wiring board 5 is supported by the support member 4, an upper portion of the groove 12 is covered with the electric wiring board 5. End portions 13*a* and 13*b* that are located at a recessed portion 10 side, of the groove 12 are not covered with the electric wiring board 5 and the recording element substrate 3. Namely, the groove 12 and the electric wiring board 5 form a passage that communicates with the inside of the recessed portion 10. Note that the passage is also called an "atmosphere communication passage".

In the present embodiment, the electric wiring board 5 has an opening of substantially the same size as the opening of the recessed portion 10, or an opening larger than the opening of the recessed portion 10 (hereinafter, called an "electric wiring board opening 14"). The opening of the recessed portion 10 is located inside the electric wiring board opening 14. The recording element substrate 3 is smaller than the opening of the recessed portion 10, and a gap is formed between the recording element substrate 3 and side surfaces of the recessed portion 10.

The recording element substrate 3 and the electric wiring board 5 are electrically connected via a plurality of lead terminals 15. The lead terminals 15 extend between the recording element substrate 3 and the side surface of the recessed portion 10. The end portion 13*a* of the groove 12 is located at a first region where the lead terminals 15 are located, of the side surfaces of the recessed portion 10. The end portion 13*b* of the groove is located at a second region different from the first region, of the side surfaces of the recessed portion 10.

As illustrated in FIG. 4, the lead terminals 15 (see FIG. 3) are covered with the sealant 6. The sealant 6 is applied to sides opposite from a bottom portion side of the recessed portion 10, of the lead terminals 15. Subsequently, the sealant 6 passes between the adjacent lead terminals 15, and the sides of the lead terminals 15 to flow into the gap between the recording element substrate 3 and the side surfaces of the recessed portion 10.

In the present embodiment, the sealant 6 is placed in only the gap between the recording element substrate 3 and the first region of the recessed portion 10. More specifically, the sealant 6 is placed between the first region of the recessed portion 10 where the end portion 13*a* of the groove 12 is located, and the recording element substrate 3, and is not placed in the gap between the second region of the recessed portion 10 where the end portion 13*b* of the groove 12 is located, and the recording element substrate 3. Accordingly, the end portion 13*b* of the groove 12 is not closed.

When the sealant 6 flows into the gap between the recording element substrate 3 and the side surfaces of the recessed portion 10, the sealant 6 traps gas in the gap, and a bubble 16 is sometimes formed in the gap, as illustrated in FIG. 5.

According to the present embodiment, as illustrated in FIGS. 3 and 4, one opening of the atmosphere communication passage, namely, the end portion 13*a* of the groove 12 is located in the sealed region where the sealant 6 is placed. Further, the other opening of the atmosphere communication passage, namely, the end portion 13*b* of the groove 12 is located in the region different from the sealed region, and therefore, is not closed. Accordingly, gas is discharged to the outside of the recording head through the atmosphere communication passage, and therefore, is difficult to trap in the gap between the recording element substrate 3 and the side surfaces of the recessed portion 10 by the sealant 6. In other words, the bubble 16 is difficult to form, and the lead terminals are sealed more reliably.

Further, even if the bubble 16 is formed in the gap between the recording element substrate 3 and the side surfaces of the recessed portion 10 when the sealant 6 is applied, the gas in the bubble 16 is discharged through the groove 12. Accordingly, even if a thermosetting material is used as the sealant 6, and the sealant 6 is cured by heating, the bubble 16 does not expand rapidly. As a result, the sealant 6 hardly scatters, and imperfect sealing hardly occurs.

When the coating amount of the sealant 6 is not sufficient, the one opening of the atmosphere communication passage, namely, the end portion 13*a* of the groove 12 is not sometimes closed by the sealant 6. In this case, there is the risk that the gas outside the recording head flows into the recessed portion 10 through the atmosphere communication passage.

In the present embodiment, the other opening of the atmosphere communication passage, namely, the end portion 13*b* of the groove 12 is located in the second region of the side surfaces of the recessed portion 10. Therefore, in the state in which the recording element substrate 3 and the opening of the recessed portion 10 are covered with the cap of the liquid ejection apparatus, the end portion 13*b* of the groove 12 is in the region that is covered with the cap. As a result, the gas outside the recording head does not flow into the recessed portion 10 through the atmosphere communication passage.

In other words, the recessed portion 10 is hermetically closed by the cap. As a result, the ink hardly dries, and the ink hardly adheres to the ejection port 2. Further, at the time of operation of the decompression unit, the gas outside the recording head is not sucked, and the adhering ink can be removed more easily. Accordingly, the recording head is difficult to bring into a state incapable of ejection.

Note that in the present embodiment, the atmosphere communication passage is formed by the groove 12 and the electric wiring board 5, but the atmosphere communication passage is not limited to this form. For example, the atmosphere communication passage may be a hole that is formed in the support member 4.

Furthermore, in the present embodiment, the other opening of the atmosphere communication passage, namely, the end portion 13*b* of the groove 12 is located at the side surface of the recessed portion 10, but the other opening is not limited to this form. The other opening of the atmosphere communication passage can be located in a region which is covered with the cap, of the support member 4.

(Second Embodiment)

Subsequently, a second embodiment according to the present invention will be described with use of FIGS. 6 to 8. Note that the same elements as the elements illustrated in FIGS. 2 to 5 will be assigned with the same reference signs, and description thereof will be omitted.

Figure 6:
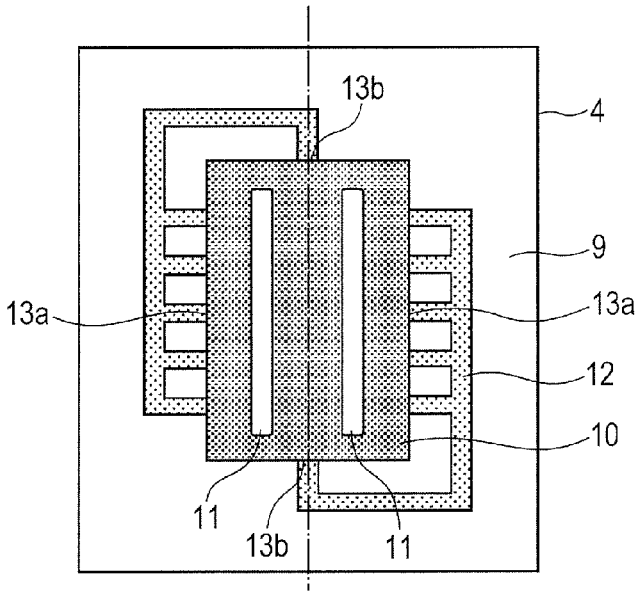
FIG. 6 is a front view of a support member of a recording head according to a second embodiment of the present invention seen from a recording element substrate side.

FIG. 6 is a front view of the support member 4 of a recording head according to the present embodiment, seen from the recording element substrate 3 side. FIG. 7 is a front view of the recording head according to the present embodiment.

Figure 7:
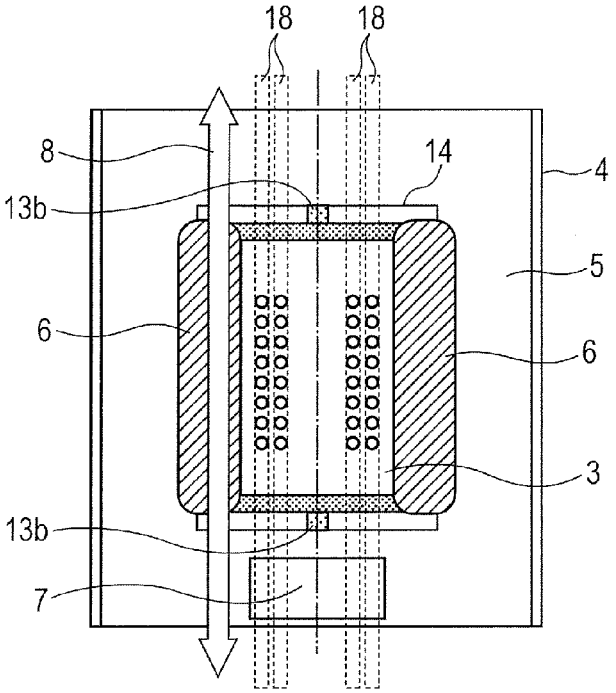
FIG. 7 is a front view of the recording head according to the second embodiment of the present invention.

As illustrated in FIGS. 6 and 7, the recording head according to the present embodiment includes the recording element substrate 3, the electric wiring board 5 and the support member 4. The support member 4 supports the recording element substrate 3 by the bottom portion of the recessed portion 10, and supports the electric wiring board 5 by the electric wiring board support plane 9.

The groove 12 is formed in the electric wiring board support plane 9, and an atmosphere communication passage is formed by the groove 12 and the electric wiring board 5. One opening of the atmosphere communication passage, namely, the end portion 13*a* of the groove 12 is located in a first region where the sealant 6 is placed, of the side surfaces of the recessed portion 10. The other opening of the atmosphere communication passage, namely, the end portion 13*b* of the groove 12 is located in a second region where the sealant 6 is not placed, of the side surfaces of the recessed portion 10.

According to the present embodiment, gas is difficult to trap in the gap between the recording element substrate 3 and the side surfaces of the recessed portion 10 by the sealant 6, and the bubble 16 is difficult to form. Even if the bubble 16 is formed in the gap between the recording element substrate 3 and the side surfaces of the recessed portion 10 when the sealant 6 is applied, the bubble 16 does not expand. As a result, the sealant 6 hardly scatters, and imperfect sealing hardly occurs. In other words, the lead terminals are sealed more reliably.

Further, in the present embodiment, the recessed portion 10 is hermetically sealed by the cap. As a result, the ink hardly dries, and the ink hardly adheres to the ejection port 2. Further, at the time of operation of the decompression unit, the gas outside the recording head is not sucked, and the adhering ink can be removed more easily. Accordingly, the recording head is hardly brought into a state incapable of ejection.

When a foreign matter sticks to the ejection port 2 and imperfect printing occurs, imperfect printing can be resolved with use of the wiping member 7 that is provided at the liquid ejection apparatus. More specifically, the wiping member 7 is moved along the moving direction 8, and the recording element substrate 3 is wiped with use of the wiping member 7. By wiping the recording element substrate with use of the wiping member 7, the foreign matter sticking to the ejection port 2 is wiped away, and imperfect printing is resolved. Note that the operation of wiping away a foreign matter by using the wiping member 7 is also called "wiping".

Figure 8:
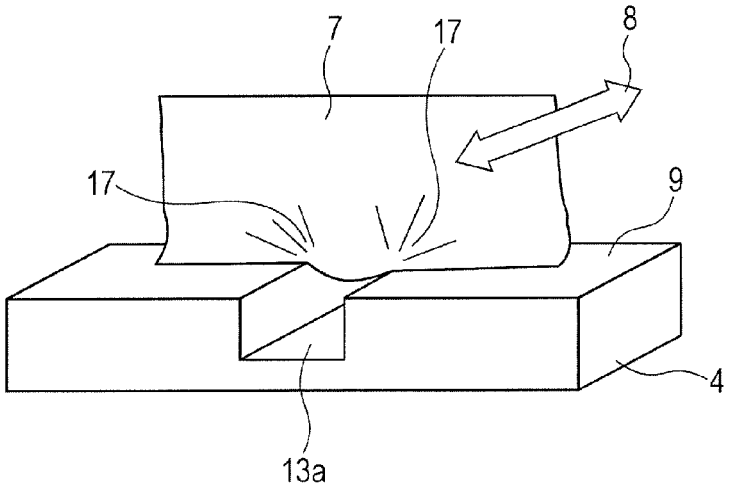
FIG. 8 is an enlarged view of a region in and around an end portion of a groove.

FIG. 8 is an enlarged view of a region in and around the end portion 13*b* of the groove 12.

The end portion 13*b* of the groove 12 forms a step in the electric wiring board support plane 9 of the support member 4. Accordingly, as illustrated in FIG. 8, when the wiping member 7 comes in contact with the electric wiring board support plane 9, stress locally arises in a region that contacts an edge of the groove 12, of the wiping member 7. When wiping is repeated a plurality of times (for example, several thousand times), a stress generation region 17 where the stress occurs, of the wiping member 7 sometimes deforms.

In the present embodiment, the other opening of the atmosphere communication passage, namely, the end portion 13*b* of the groove 12 is located outside an area 18 that extends in the moving direction 8 from the ejection port 2. Accordingly, the wiping portion of the wiping member 7 that wipes the ejection port 2 does not pass the end portion 13*b* of the groove 12.

In other words, the wiping portion of the wiping member 7 and the stress generation region 17 of the wiping member 7 are different regions. Since local stress does not arise in the wiping portion, the wiping portion does not deform even if wiping is repeated, and imperfect wiping hardly occurs.

(Third Embodiment)

Subsequently, a third embodiment according to the present invention will be described with use of FIGS. 9 to 11. Note that the same elements as the elements illustrated in FIGS. 2 to 8 will be assigned with the same reference signs, and description thereof will be omitted.

Figure 9:
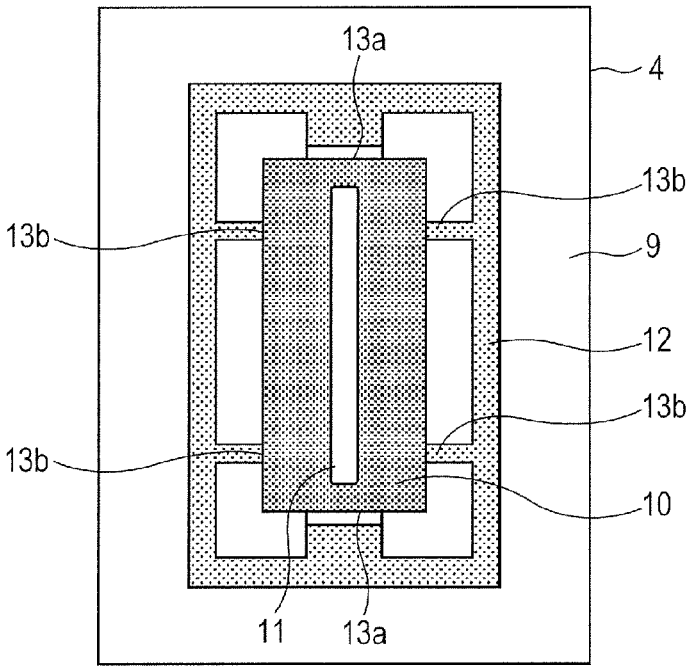
FIG. 9 is a front view of a support member of a recording head according to a third embodiment of the present invention seen from a recording element substrate side.

FIG. 9 is a front view of the support member 4 of a recording head according to the present embodiment, seen from a recording element substrate 3 side. FIG. 10 is a front view of the recording head according to the present embodiment.

Figure 10:
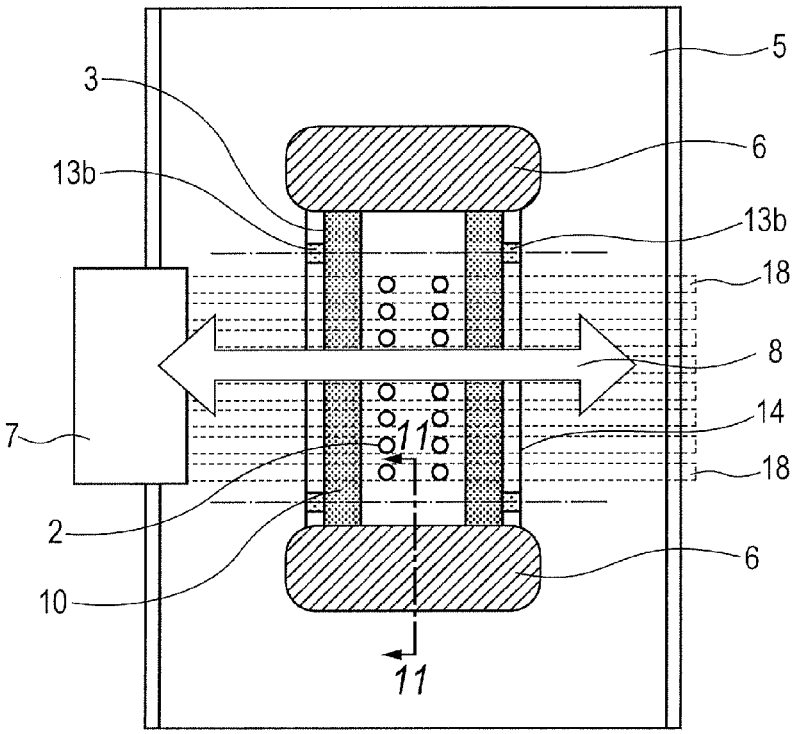
FIG. 10 is front view of the recording head according to the third embodiment of the present invention.

As illustrated in FIGS. 9 and 10, the recording head includes the recording element substrate 3, the electric wiring board 5 and the support member 4. The support member 4 supports the recording element substrate 3 by a bottom portion of the recessed portion 10, and supports the electric wiring board 5 by the electric wiring board support plane 9.

The groove 12 is formed in the electric wiring board support plane 9, and an atmosphere communication passage is formed by the groove 12 and the electric wiring board 5. One opening of the atmosphere communication passage, namely, the end portion 13*a* of the groove 12 is located in a first region where the sealant 6 is placed, of the side surfaces of the recessed portion 10. The other opening of the atmosphere communication passage, namely, the end portion 13*b* of the groove 12 is located at a second region where the sealant 6 is not placed, of the side surfaces of the recessed portion 10.

According to the present embodiment, gas is difficult to trap in a gap between the recording element substrate 3 and the side surface of the recessed portion 10 by the sealant 6, and the bubble 16 is difficult to form. Even if the bubble 16 is formed in the gap between the recording element substrate 3 and the side surface of the recessed portion 10 when the sealant 6 is applied, the bubble 16 does not expand. As a result, the sealant 6 hardly scatters, and imperfect sealing hardly occurs. In other words, the lead terminals are sealed more reliably.

Further, in the present embodiment, the recessed portion 10 is hermetically sealed by a cap. As a result, an ink hardly dries, and the ink hardly adheres to the ejection port 2. Further, at the time of an operation of decompression unit, gas outside the recording head is not sucked, and the adhering ink can be removed more easily. Accordingly, the recording head is hardly brought into a state incapable of ejection.

In the present embodiment, a plurality of ejection ports 2 are aligned in a direction different from the moving direction 8. The other opening of the atmosphere communication passage, namely, the end portion 13*b* of the groove 12 is located outside from the ejection ports 2 that are located at an end with respect to the direction in which the plurality of ejection ports 2 are aligned. Accordingly, the wiping member 7 can be moved within a region where the wiping member 7 does not contact the end portion 13*b* of the groove 12 while wiping the plurality of ejection ports 2. As a result, deformation of the wiping member 7 by wiping the recording element substrate 3 is further restrained, and imperfect wiping is further restrained.

Figure 11:
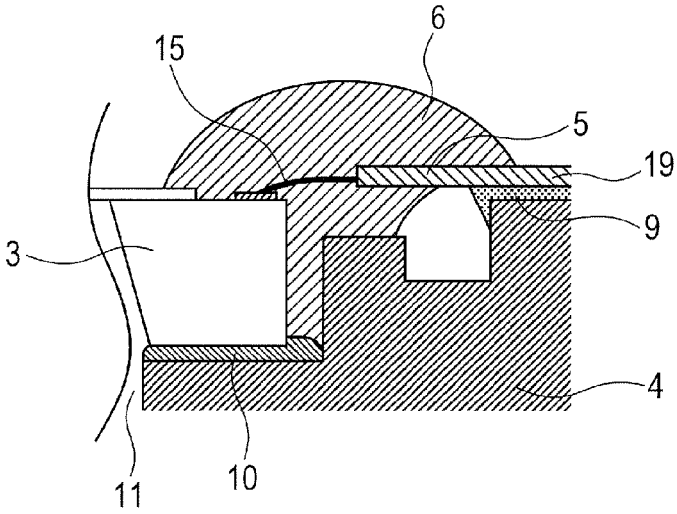
FIG. 11 is a sectional view of the recording head illustrated in FIG. 10.

FIG. 11 is a sectional view of the recording head illustrated in FIG. 10 at a time of being cut along a 11-11 plane. As illustrated in FIG. 11, an adhesive 19 that is applied onto the electric wiring board support plane 9 sometimes spreads out from the electric wiring board support plane 9, flows into a part of the groove 12 (see FIG. 9), and closes a part of the groove 12 and the end portion 13*b* (see FIGS. 9 and 10) of the groove 12.

In the present embodiment, as illustrated in FIGS. 9 and 10, the groove 12 has a plurality of end portions 13*b*. The end portion 13*a* of the groove 12 communicates with a plurality of end portions 13*b*. Accordingly, even if one of the end portions 13*b* of the groove 12 is closed by the adhesive 19 (see FIG. 11), gas is discharged through the other end portion of the end portions 13*b* of the groove 12.

In other words, the gas flows from the one opening of the atmosphere communication passage to the other opening that is not closed through the atmosphere communication passage, and is more reliably discharged to the outside of the recording head. Accordingly, the gas is difficult to trap in the gap between the recording element substrate 3 and the side surface of the recessed portion 10 by the sealant 6, and the bubble 16 is difficult to form. As a result, the lead terminals are sealed more reliably.

Further, even if the bubble 16 is formed in the gap between the recording element substrate 3 and the side surface of the recessed portion 10 when the sealant 6 is applied, the gas in the bubble 16 is discharged from the other opening that is not closed through the atmosphere communication passage. Accordingly, even if a thermosetting material is used as the sealant 6, and the sealant 6 is cured by heating, the bubble 16 does not rapidly expand. As a result, the sealant 6 hardly scatters, and imperfect sealing hardly occurs.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-083710, filed Apr. 12, 2013, which is hereby incorporated by reference herein in its entirety.

What is claimed is:

1. A liquid ejection head, comprising:

a recording element substrate having a plurality of aligned ejection ports;

a support member having a recessed portion, and supporting the recording element substrate by a bottom portion of the recessed portion;

a lead terminal electrically connected to the recording element substrate, and extending between the recording element substrate and a side surface of the recessed portion;

a sealant which is placed between the recording element substrate and the side surface of the recessed portion, and with which the lead terminal is covered; and a passage formed in the support member, and having one opening in a sealed region where the sealant is placed and having another opening in a region different from the sealed region, wherein the other opening is located in a region of the support member covered with a cap, with which at least the recording element substrate and an opening of the recessed portion are covered, and wherein the other opening is located on an outer side from an end ejection port that is located at an end position of the plurality of aligned ejection ports.

2. The liquid ejection head according to claim 1, further comprising:

an electric wiring board electrically connected to the recording element substrate via the lead terminal, wherein the support member includes an electric wiring board support plane that supports the electric wiring board, and a groove formed in the electric wiring board support plane, and extending from the one opening to the other opening, and the passage is formed by the groove and the electric wiring board that is supported by the electric wiring board support plane.

3. The liquid ejection head according to claim 1, wherein the sealant is placed only between the recording element substrate and a first region where the lead terminal is located, of side surfaces of the recessed portion, and the other opening of the passage is located in a second region different from the first region, of the side surfaces of the recessed portion.

4. The liquid ejection head according to claim 1, wherein the passage has a plurality of the other openings, and the one opening of the passage communicates with the plurality of the other openings.

5. A liquid ejection apparatus, comprising:

a liquid ejection head, a the liquid ejection head comprising:

a recording element substrate having a plurality of aligned ejection ports;

a support member having a recessed portion, and supporting the recording element substrate by a bottom portion of the recessed portion;

a lead terminal electrically connected to the recording element substrate, and extending between the recording element substrate and a side surface of the recessed portion;

a sealant which is placed between the recording element substrate and the side surface of the recessed portion, and with which the lead terminal is covered; and a passage formed in the support member, and having one opening in a sealed region where the sealant is placed and having another opening in a region different from the sealed region; and a cap with which at least the recording element substrate and an opening of the recessed portion are covered, wherein the other opening is located in a region of the support member covered with the cap, and wherein the other opening is located on an outer side from an end ejection port that is located at an end position of the plurality of aligned ejection ports.

6. The liquid ejection apparatus according to claim 5, further comprising:

a decompression unit connected to the cap, and decompressing a space in the recessed portion covered with the cap.

7. The liquid ejection apparatus according to claim 5, further comprising:

a wiping member that moves in a predetermined direction, and wipes the recording element substrate.

* * * * *